US009456950B2

(12) United States Patent
Lee

(10) Patent No.: US 9,456,950 B2
(45) Date of Patent: Oct. 4, 2016

(54) VARIABLE ACUPRESSURE BALL FOR MASSAGING APPARATUS

(71) Applicants: Happyroom Co., Ltd., Anyang-si (KR); hosungtech, Anyang-si (KR)

(72) Inventor: Ho Youen Lee, Gunpo-si (KR)

(73) Assignees: HAPPYROOM CO., LTD., Anyang-Si (KR); HOSUNGTECH, Anyang-Si (KR)

( * ) Notice: Subject to any disclaimer, the term of this patent is extended or adjusted under 35 U.S.C. 154(b) by 296 days.

(21) Appl. No.: 14/234,513

(22) PCT Filed: Nov. 20, 2012

(86) PCT No.: PCT/KR2012/009836

§ 371 (c)(1),
(2) Date: Jan. 23, 2014

(87) PCT Pub. No.: WO2013/108985

PCT Pub. Date: Jul. 25, 2013

(65) Prior Publication Data

US 2014/0163442 A1 Jun. 12, 2014

(30) Foreign Application Priority Data

Jan. 17, 2012 (KR) ..... 10-2012-0005195

(51) Int. Cl.

| | |
|---|---|
| ***A61H 39/04*** | (2006.01) |
| ***A61H 7/00*** | (2006.01) |
| ***A61H 1/00*** | (2006.01) |

(52) U.S. Cl.

CPC ..... *A61H 1/008* (2013.01); *A61H 7/005* (2013.01); *A61H 7/007* (2013.01); *A61H 39/04* (2013.01); *A61H 2201/1215* (2013.01); *A61H 2201/14* (2013.01); *A61H 2201/1671* (2013.01); *A61H 2205/04* (2013.01); *A61H 2205/06* (2013.01);

(Continued)

(58) Field of Classification Search

CPC ..... A61H 39/00; A61H 39/04; A61H 7/00; A61H 7/007; A61H 1/008; A61H 2201/14

See application file for complete search history.

(56) References Cited

U.S. PATENT DOCUMENTS 1,724,842 A * 8/1929 Kazmazyk ..... A61H 7/00 132/212
1,913,462 A * 6/1933 Timar ..... A61H 7/003 601/135

(Continued)

FOREIGN PATENT DOCUMENTS

JP 62109569 A 5/1987
JP 1147837 U 10/1989

(Continued)

*Primary Examiner* — Justine Yu
*Assistant Examiner* — Christopher Miller
(74) *Attorney, Agent, or Firm* — Revolution IP, PLLC

(57) ABSTRACT

Provided is a variable acupressure ball for a massaging apparatus having a drive motor, a reducer connected to the drive motor, and an acupressure unit which has at least one acupressure ball disposed on top of a body thereof and which is coupled to a rotational shaft of the reducer so as to be rotated together. The variable acupressure ball includes a shaft protruding from the top of the body of the acupressure unit, a cap-shaped acupressure ball loosely fitted around the shaft, and an elastic unit resiliently restoring an interval between the cap-shaped acupressure ball and the shaft. The acupressure ball formed on the acupressure unit is variable in position according to acupressure strength.

1 Claim, 4 Drawing Sheets

(52) U.S. Cl.
CPC ..... *A61H 2205/08* (2013.01); *A61H 2205/10* (2013.01)

(56) References Cited

U.S. PATENT DOCUMENTS

| | | | | | |
|---|---|---|---|---|---|
| 3,364,922 | A * | 1/1968 | Teranishi | A61H 23/0263 | 601/72 |
| 3,424,149 | A * | 1/1969 | Fujimoto | A61H 23/0254 | 601/111 |
| 3,625,204 | A * | 12/1971 | Sekiguchi | A61H 7/003 | 601/134 |
| 3,856,002 | A * | 12/1974 | Matsumoto | A61H 7/003 | 601/137 |
| 4,733,655 | A | 3/1988 | Smal | | |
| 5,018,511 | A * | 5/1991 | Yokoi | A61H 23/0254 | 601/103 |
| 5,458,561 | A * | 10/1995 | Schweisfurth | A61H 15/0092 | 601/119 |
| 5,607,749 | A * | 3/1997 | Strumor | A43B 7/146 | 297/DIG. 8 |
| 5,662,593 | A * | 9/1997 | Tillman | A61H 15/0085 | 601/113 |
| 5,792,175 | A * | 8/1998 | Yoo | A61H 39/04 | 601/134 |
| 5,836,901 | A * | 11/1998 | Shenkal | A61H 7/003 | 601/134 |
| 8,128,583 | B2 * | 3/2012 | Ghatge | A61H 15/00 | 601/134 |
| 2001/0001810 | A1 * | 5/2001 | Quinn | A61H 7/00 | 601/136 |
| 2004/0098036 | A1 * | 5/2004 | Bergersen | A61H 39/04 | 606/204 |
| 2006/0173389 | A1 * | 8/2006 | Chai | A61H 15/00 | 601/135 |
| 2007/0093736 | A1 * | 4/2007 | Hebert | A61H 7/003 | 601/137 |
| 2008/0262397 | A1 * | 10/2008 | Habatjou | A61H 7/001 | 601/93 |
| 2008/0262398 | A1 * | 10/2008 | Ferber | 601/98 | |
| 2009/0118652 | A1 * | 5/2009 | Carlucci | A61H 7/007 | 601/134 |
| 2012/0253243 | A1 * | 10/2012 | Ikeyama | A61H 23/0263 | 601/46 |

FOREIGN PATENT DOCUMENTS

| | | | |
|---|---|---|---|
| JP | 8173499 | A | 7/1996 |
| JP | 2003325626 | A | 11/2003 |
| JP | 200481416 | A | 3/2004 |
| JP | 201088577 | A | 4/2010 |
| KR | 1020050001024 | A | 1/2005 |
| KR | 1020100082739 | A | 7/2010 |

* cited by examiner

VARIABLE ACUPRESSURE BALL FOR MASSAGING APPARATUS

CROSS-REFERENCE TO RELATED APPLICATIONS

This application is the United States national phase of International Application No. PCT/KR2012/009836 filed Nov. 20, 2012, and claims priority to Korean Patent Application No. 10-2012-0005195 filed Jan. 17, 2012, the disclosures of which are hereby incorporated in their entirety by reference.

TECHNICAL FIELD

The present invention relates generally to a massaging apparatus and, more particularly, to a variable acupressure ball for a massaging apparatus, in which the acupressure ball formed on an acupressure unit is configured to be variable in position according to acupressure strength, thereby maintaining appropriate acupressure strength to the maximum extent because the acupressure ball provides a variable acupressure position in accordance with a physique rather than an invariable acupressure position regardless of the physique.

The phrase "acupressure ball" is defined as a cap-shaped acupressure applicator.

DESCRIPTION OF RELATED ART

In general, massaging apparatuses are machines that press or beat the back, waist, and/or neck to relax stiffened muscles, thereby enabling a user to feel refreshed and helping blood circulation to promote the user's health. Massaging apparatuses designed to massage body parts including the inner thighs, calves, feet, arms, and neck, and trapezius muscles in addition to the back and the waist have recently been widely used.

Massaging apparatuses are generally operated under one of three principles. The first principle is to massage by rotating an acupressure unit by rotation of a motor such that an acupressure ball protruding from one surface of the acupressure unit presses a body part as if fingers were pressing the body part. The second principle is to massage by pressing a body part while a roller rolls on a rail. The third principle is to massage in a rhythmic manner under the control of various action sequences of multiple arranged solenoids to prevent boredom.

With regard to a feeling or effect of massage using hands, the massage based on the rotation of the acupressure unit is more excellent than the massage based on the solenoids, and the massage based on the roller is most excellent.

However, in the case of the massaging apparatus using the movement of the roller, the roller moves while bearing the weight of a user who is reclining, and the rail is required for smooth movement of the roller. In view of a structure of the rail, the roller simply reciprocates backward and forward in a straight line. As such, there is a limitation to massaging the back or waist. Since the massage is performed by one roller, the massaging apparatus using the movement of the roller has a slow acupressure speed, a great volume, and a high price.

Above all, since lines of the human body are curved, narrow parts such as the waist or neck are subjected to low acupressure strength, and flat parts such as the back are subjected to high acupressure strength. In the latter case, the user suffers pain, and more harm than good is done to the old and the weak.

To massage the curves of the human body, i.e. the neck, the shoulders, and the waist, in this way, the massaging apparatus in which massage is performed by rotating the acupressure balls is suitable. The massaging apparatus has a simple structure in which the acupressure units are rotated by the motors and the reducers, a small volume, and a low price. Further, the various body parts including the neck, the shoulders, the thighs, the calves, the arms, the back, and the waist can be changed in posture and position as needed and massaged by the massaging apparatus.

However, the rotating acupressure units are installed at predetermined intervals, and the body part to be massaged is positioned between the acupressure units. The interval between the acupressure units is constant, and the interval between the acupressure balls formed on the acupressure units is constant. As such, the body part positioned between the acupressure units is massaged without a change of the position regardless of its size. In the case of a user having a small physique, the interval from the acupressure ball is too wide, and the acupressure strength is weak. In contrast, in the case of a user having a large physique, the acupressure ball massages too strongly, and the user feels pain.

SUMMARY OF THE INVENTION

Technical Problem

Accordingly, the present invention has been made keeping in mind the above problems occurring in the related art, and an object of the present invention is to provide a variable acupressure ball for a massaging apparatus, in which the acupressure ball installed on an acupressure unit is configured to be resiliently variable in position by an elastic means, and an interval between the acupressure balls of the two acupressure units is changed to some extent so as to adjust acupressure strength, thereby enabling a user to be massaged in a more comfortable way.

Technical Solution

To accomplish the object, there is provided a variable acupressure ball for a massaging apparatus having a drive motor, a reducer connected to the drive motor, and an acupressure unit which has at least on acupressure ball disposed on top of a body thereof and which is coupled to a rotational shaft of the reducer so as to be rotated together. The variable acupressure ball includes:

a shaft protruding from the top of the body of the acupressure unit;

a cap-shaped acupressure ball loosely fitted around the shaft; and an elastic means resiliently restoring an interval between the cap-shaped acupressure ball and the shaft.

Further, the elastic means may include main elastic members coupled to opposite sides of the cap-shaped acupressure ball, and ends of the main elastic members may include a mount assembled to the acupressure unit body.

Further, the elastic means may be an elastic member coupled between an inner surface of the cap-shaped acupressure ball and the shaft or the shaft itself formed of an elastic rod.

Further, the mount may include a fixing plate integrally formed with the main elastic members and an auxiliary elastic member. The fixing plate may include mounting holes, and the acupressure unit body may include coupling protrusions corresponding to the mounting holes so as to be fitted into the mounting holes.

Advantageous Effects

The variable acupressure ball for a massaging apparatus according to the present invention is configured to be resiliently variable in position by the elastic means when predetermined pressure is applied to the acupressure ball of the acupressure unit by the elastic means. As such, an interval between the acupressure balls of the acupressure units is variable to some extent according to a physique of a user so as to be adjusted to appropriate acupressure strength, and thus the user can be safely massaged in a more comfortable way.

DETAILED DESCRIPTION

Hereinafter, an embodiment of the present invention will be described in detail with reference to the accompanying drawings.

Figure 1:
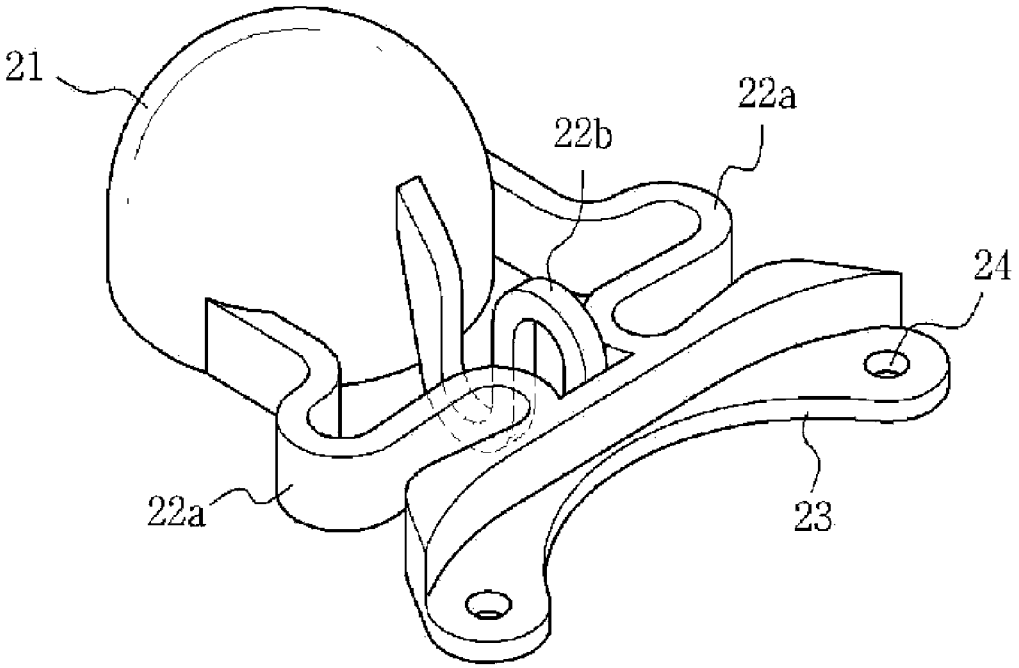
FIG. 1 is a perspective view showing a structure of a cap-shaped acupressure ball of an acupressure unit in accordance with a first embodiment of the present invention.
Figure 2:
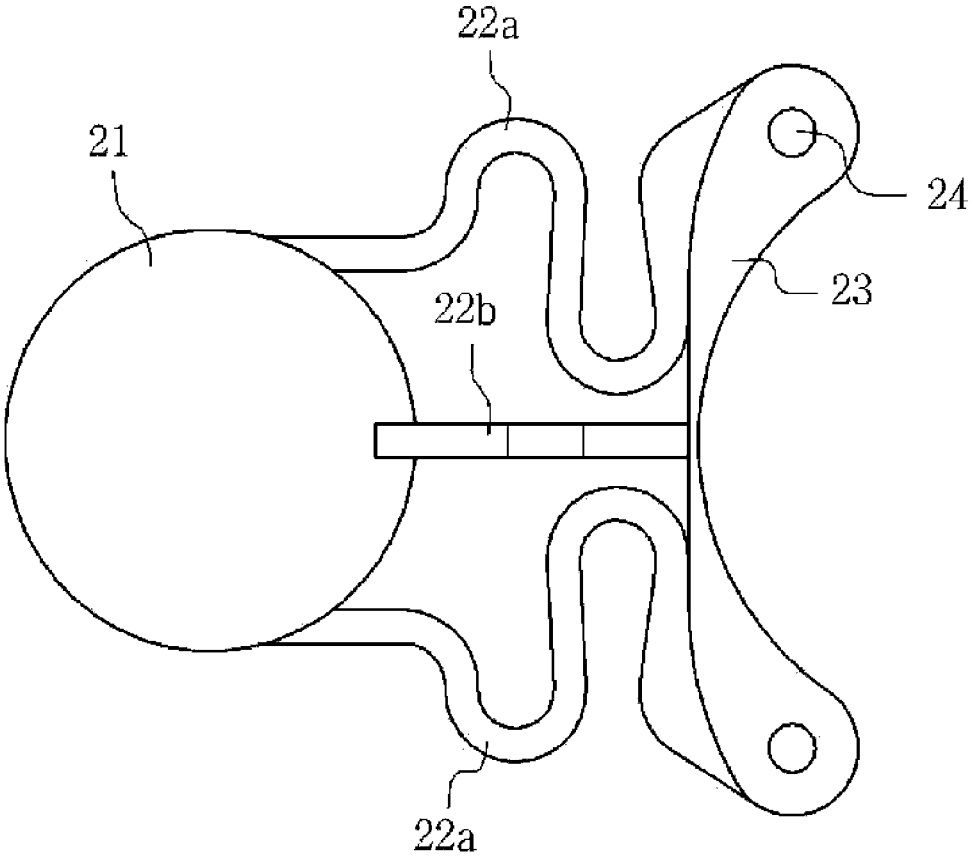
FIG. 2 is a plan view showing the structure of the cap-shaped acupressure ball of the acupressure unit in accordance with the first embodiment of the present invention.
Figure 3:
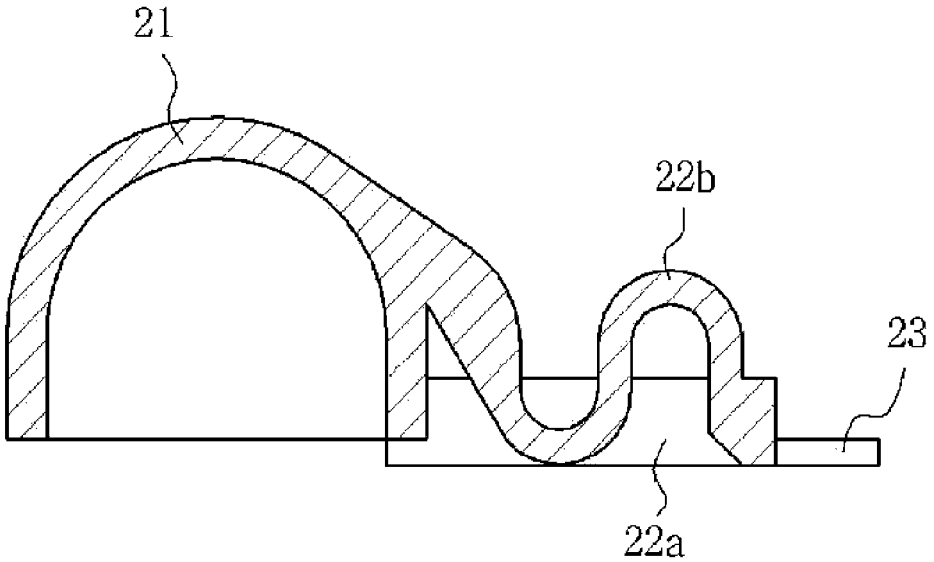
FIG. 3 is a cross-sectional view showing the structure of the cap-shaped acupressure ball of the acupressure unit in accordance with the first embodiment of the present invention.
Figure 4:
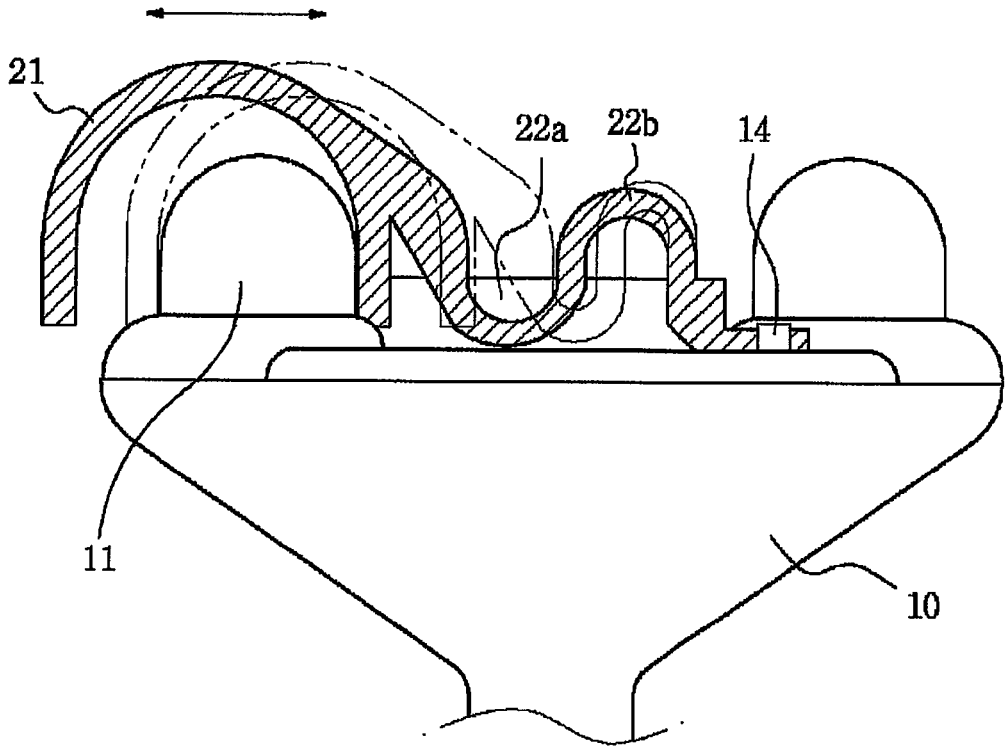
FIG. 4 is a cross-sectional view showing the cap-shaped acupressure ball of the acupressure unit that is in use in accordance with the first embodiment of the present invention.

FIG. 1 is a perspective view showing a structure of a cap-shaped acupressure ball of an acupressure unit in accordance with a first embodiment of the present invention. FIG. 2 is a plan view showing the structure of the cap-shaped acupressure ball of the acupressure unit. FIG. 3 is a cross-sectional view showing the structure of the cap-shaped acupressure ball of the acupressure unit. FIG. 4 is a cross-sectional view showing the cap-shaped acupressure ball of the acupressure unit that is in use.

An acupressure unit of a massaging apparatus is rotatably coupled to a rotational shaft of a reducer which is connected to a drive motor.

One or two or more acupressure balls are disposed on an upper surface of a body 10 of the acupressure unit. When pressure exceeding preset pressure is applied to the acupressure ball, the acupressure ball is configured to move at a preset interval so as to prevent a massage recipient from suffering pain due to excessive acupressure.

To this end, a shaft 11 protrudes from the upper surface of the acupressure unit body 10, and is loosely covered with the cap-shaped acupressure ball 21. A space between the cap-shaped acupressure ball 21 and the shaft 11 is maintained by a separate elastic means.

The elastic means maintaining the space between the cap-shaped acupressure ball 21 and the shaft 11 may be one of three types.

Embodiment 1

As shown in FIGS. 1 to 4, Embodiment 1 is configured with main elastic members 22*a* formed on opposite sides of the cap-shaped acupressure ball 21. If necessary, an auxiliary elastic member 22*b* may be provided in the middle between the main elastic members 22*a*.

A fixing plate 23 is provided for ends of the main elastic members 22*a* and the auxiliary elastic member 22*b*. The fixing plate 23 is fixed to the acupressure unit body 10. To this end, the fixing plate 23 has mounting holes 24 formed on opposite sides thereof, and the acupressure unit body 10 is provided with coupling protrusions 14 that correspond to the mounting holes and are forcibly fitted into the mounting holes 24. The fixing plate 23 is fixed by assembling the mounting holes and the coupling protrusions. Alternatively, the fixing plate 23 may be fixed to the acupressure unit body 10 by screws or an adhesive.

MODE FOR INVENTION

Embodiment 2

Figure 5:
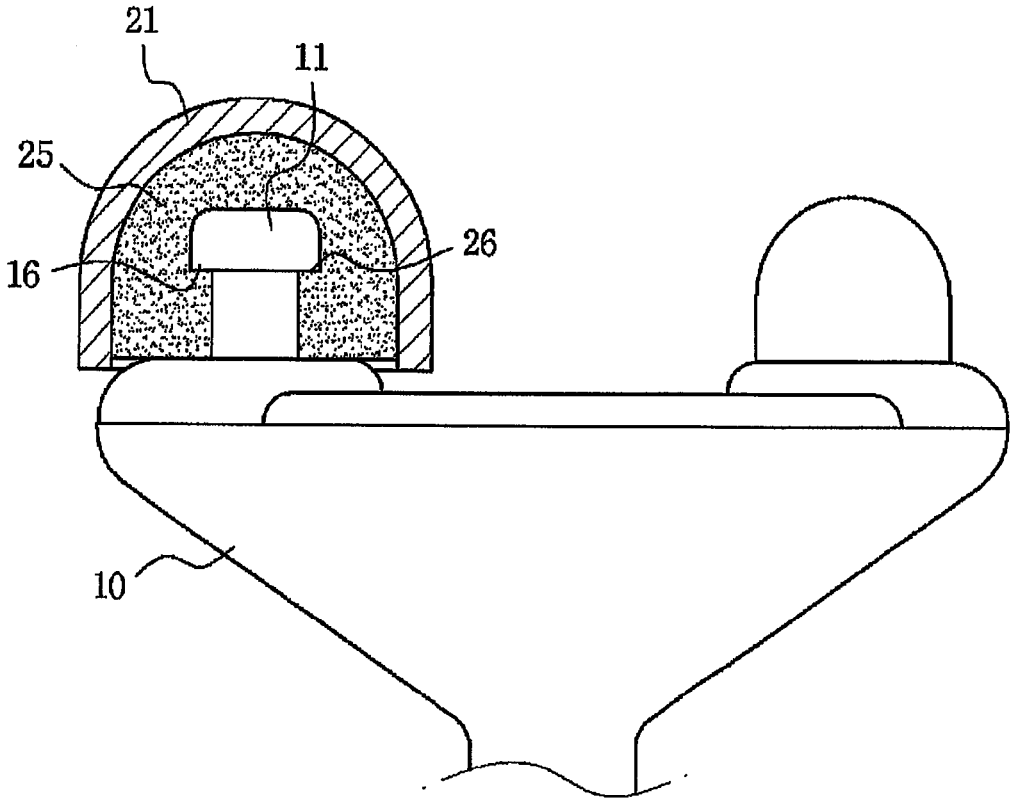
FIGS. 5 and 6 are cross-sectional views showing a structure of a cap-shaped acupressure ball of an acupressure unit in accordance with a second embodiment of the present invention.
Figure 6:
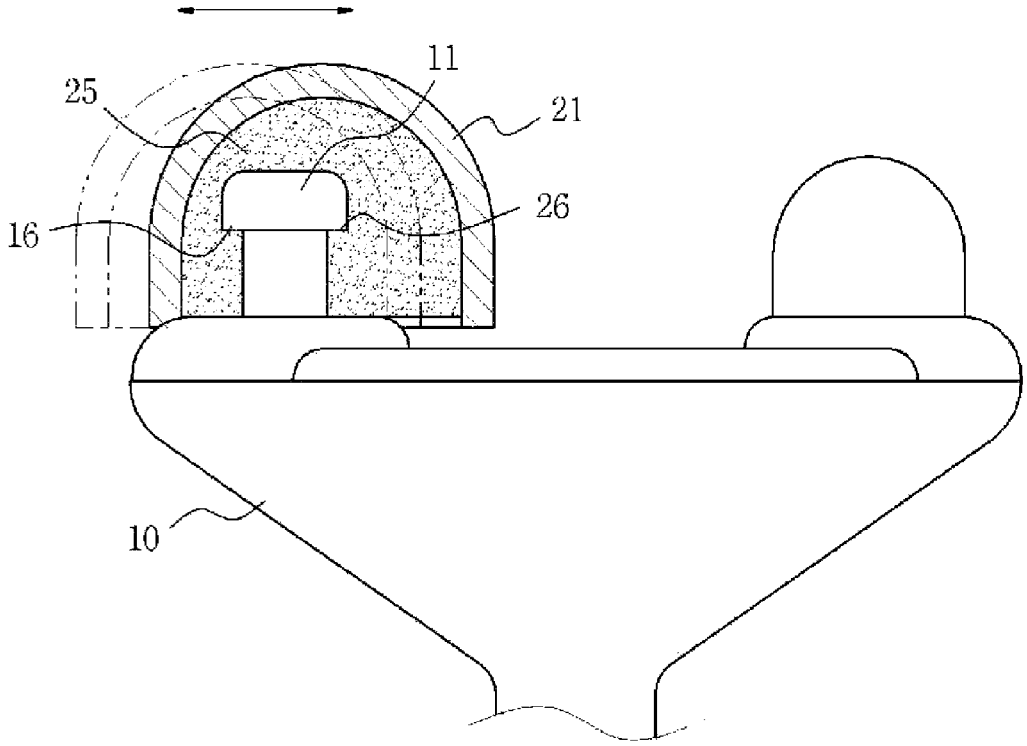

As shown in FIGS. 5 and 6, Embodiment is configured with an elastic member 25 provided inside a cap-shaped acupressure ball 21, and a shaft 11 coupled with the elastic member 25 so as to elastically maintain a space between the cap-shaped acupressure ball 21 and the shaft 11.

The elastic member 25 is simply formed of elastic rubber (synthetic rubber). Alternatively, the elastic member 25 may be formed of a coil spring or a leaf spring.

Here, a flange 16 is formed on an end of the shaft so as to prevent the cap-shaped acupressure ball 21 from being easily separated from the shaft 11. The elastic member 25 is provided with a hook cavity 26 so as to correspond to the flange. Thus, the shaft and the elastic member can be securely coupled.

Embodiment 3

Figure 7:
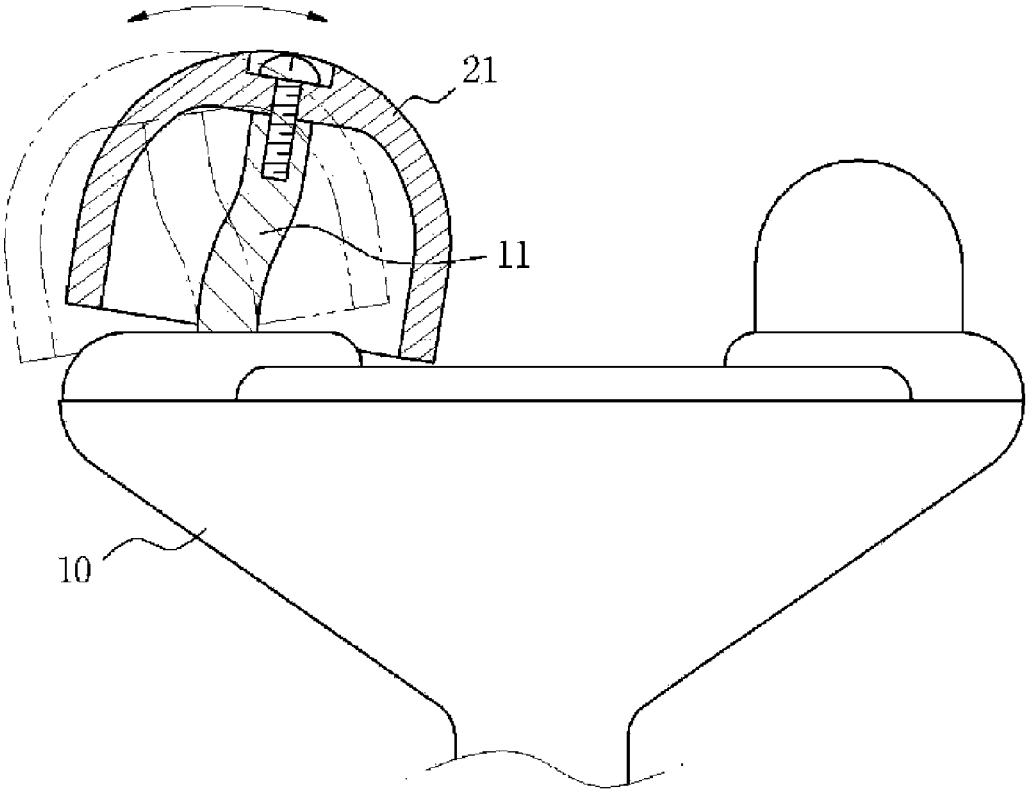
FIG. 7 is a cross-sectional view showing the cap-shaped acupressure ball of the acupressure unit that is in use in accordance with the second embodiment of the present invention.

As shown in FIG. 7, Embodiment 3 is configured to give elasticity to the shaft 11. In other words, the shaft 11 is configured to function as a spring.

In this structure, when pressure exceeding preset pressure is applied to the cap-shaped acupressure ball 21, the shaft 11 is bent, and the cap-shaped acupressure ball 21 is displaced.

As in Embodiments 1 to 3 in which the cap-shaped acupressure ball 21 is separated from the acupressure unit body 10, when the pressure exceeding preset pressure is applied to the cap-shaped acupressure ball 21, the cap-shaped acupressure ball 21 is displaced by a predetermined interval. As such, a person who is being massaged by the massaging apparatus is prevented from feeling pain or being injured by excessive acupressure of the acupressure unit.

For example, in the massaging apparatus in which a pair of acupressure balls massage a human body while a pair of acupressure units are rotated, the neck, waist, arm, or leg is positioned between the two acupressure units and massaged. However, in the case of a large human body, an interval between the two acupressure units is relatively narrow. As such, during the massage, the acupressure balls apply too much pressure to a specific spot on the body, thereby causing pain or wounding.

However, as in Embodiments 1 to 3 in which the cap-shaped acupressure balls 21 can be displaced within the respective acupressure unit bodies 10 by a predetermined interval, the cap-shaped acupressure balls are retreated when excessive acupressure is applied, and an interval between the cap-shaped acupressure balls is widened. As a result, the excessive acupressure is not applied as in the related art.

Therefore, it is possible to guarantee a safe and comfortable massage.

While the embodiment of the present invention has been described in detail with reference to the drawings, it will be understood by those skilled in the art that the invention can be implemented in other specific forms without changing the technical spirit or essential features of the invention. Therefore, the scope of embodiment in accordance with the present invention is defined by the appended claims and their equivalents.

The invention claimed is:

1. A massaging apparatus, comprising, a body;

an acupressure unit disposed on an upper surface of the body;

a shaft protruding from the upper surface of the body;

at least one variable acupressure applicator having a cap shape movably coupled to the shaft, wherein the acupressure unit is comprised of the shaft and the at least one variable acupressure applicator; and an elastic means resiliently restoring an interval between the at least one variable acupressure applicator and the shaft, the elastic means comprising two main elastic members and an auxiliary elastic member, wherein, one end of each main elastic member is coupled to opposite sides of an outer portion of the at least one variable acupressure applicator and the other end of each main elastic member is connected to a mount assembled to the body, and the auxiliary elastic member is disposed between each of the main elastic members, wherein the mount comprises a fixing plate integrally formed with each of the main elastic members, a mounting hole formed in the fixing plate, wherein a coupling protrusion formed on the upper surface of the body corresponds to the mounting hole so as to be fitted into the mounting hole.

* * * * *